United States Patent [19]

Wahi

[11] 4,084,878

[45] * Apr. 18, 1978

[54] CONNECTOR

[75] Inventor: Chander Mohan Wahi, Waseca, Minn.

[73] Assignee: E. F. Johnson Company, Waseca, Minn.

[ * ] Notice: The portion of the term of this patent subsequent to May 18, 1994, has been disclaimed.

[21] Appl. No.: 452,689

[22] Filed: Mar. 20, 1974

[51] Int. Cl.[2] ..... H01R 13/38

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,434,093 | 3/1969 | Wedekind | 339/99 R X |
| 3,444,506 | 5/1969 | Wedekind | 339/99 R |
| 3,805,214 | 4/1974 | Demler et al. | 339/97 R X |
| 3,820,055 | 6/1974 | Huffnagle et al. | 339/97 P |
| 3,820,058 | 6/1974 | Friend | 339/99 R |
| 3,824,530 | 7/1974 | Roberts et al. | 339/99 R |

*Primary Examiner*—Roy Lake
*Assistant Examiner*—Howard N. Goldberg
*Attorney, Agent, or Firm*—Warren A. Sturm

[57] ABSTRACT

A solderless connector having a plurality of contacts with provision for strain relief. The two-part connector has a first half in which a plurality of bifurcated contacts are disposed to extend upwardly therefrom. The second half includes wire receiving slots, a strain relief member that extends into a recess in the first member and a like plurality of tapered apertures in registration with the bifurcated contacts.

2 Claims, 8 Drawing Figures

CONNECTOR

BACKGROUND OF THE INVENTION

This invention relates generally to solderless connectors and is more particularly directed to solderless connectors of the type wherein one or more insulated conductors are to be reliably connected to one or more corresponding contact members which, in turn, may be connected to other contact members to effect a reliable electrical connection from input to the output of the electrical connector. Many prior art devices have been developed for accomplishing the general purposes of my invention. However, reliability and/or cost have proven to be factors which do not coexist.

In a device incorporating the principles of my invention, one or more of a plurality of conductors as may exist, for example, in a ribbon-type cable in which conductors are disposed in parallel side-by-side relationship, and may be connected to contacts in a plug or receptacle and are engaged in such a manner so as to prevent malfunction due to stresses or strains as may be exerted on the cabled conductors or the conductor in conductive engagement with the connectors in the plug or receptacle.

It is therefore an object of my invention to provide a connector plug or receptacle which attains a higher degree of reliability in conductively engaging the conductor or conductors of a cable.

Another object of my invention is to provide an improved strain relief facility within a connector plug or receptacle.

These and other objects of my invention may become apparent from a consideration of the appended specification, claims and drawing in which;

DESCRIPTION OF THE PREFERRED EMBODIMENT

Figure 1:
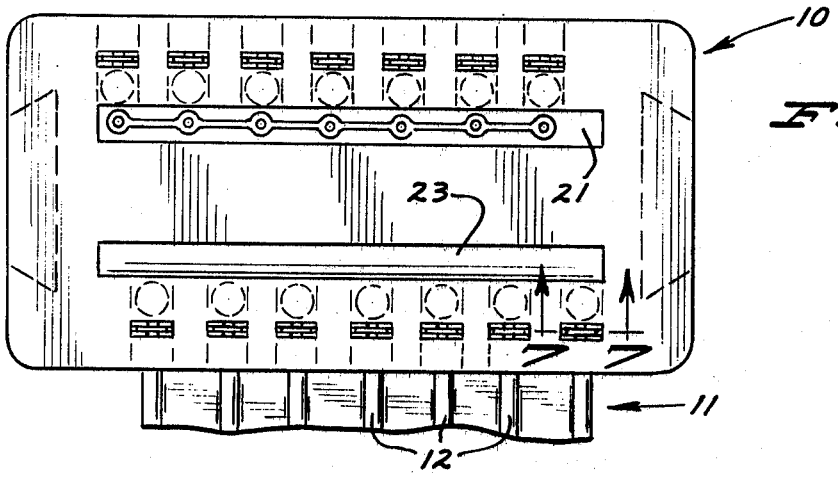
FIG. 1 is a top plan view of a connector receptacle embodying the principles of my invention.

Referring to all of the figures of the drawings, a receptacle assembly, indicated generally by reference character 10, is illustrated in operative, interengaging, conductive relationship with a ribbon wire cable 11 having a plurality of insulated conductors 12, disposed therein.

The base of the connector is indicated generally by reference character 15 and includes a plurality of apertures 16 for receiving and mounting a plurality of conductive contact members 28. Members 28 are shown having a pin receiving end 29, a center portion 30 and a pair of bifurcated end portions 31 and 32, shown in generally parallelly disposed relationship to form a tapered notch therebetween so as to engage and penetrate the insulation on an insulated wire and to thereafter conductively engage a conductor or conductors disposed thereon. As a conductor or said bifurcated end portions 31 and 32 are moved relative to one another, the insulation of the conductor is penetrated and a conductive engagement is secured thereto.

It may be noted that the recesses formed in base 15, as indicated by reference characters 17, are disposed at predetermined locations and are laterally spaced apart a predetermined distance so as to coincide and thereby coact with predetermined conductors in a flat ribbon cable and to coact with suitably like dimensioned plug members to effect a connection between the cables and whatever apparatus may be connected to the male pins of a plug mounted on another cable or upon a chassis or the like to effect a reliable electrical connection therebetween.

Figure 6:
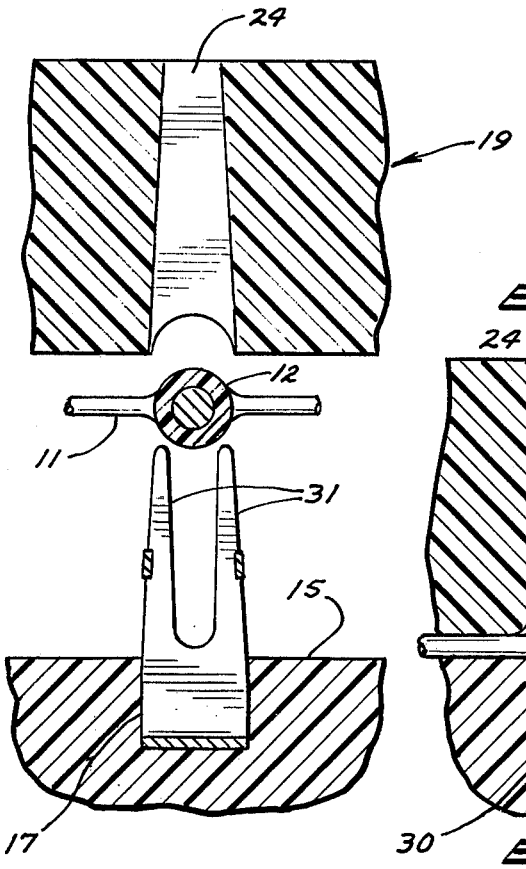
FIGS. 6, 7 and 8 are enlarged fragmentary sectional views illustrating the interrelationship between the various elements of my invention and a conductor to be conductively engaged thereby.
Figure 7:
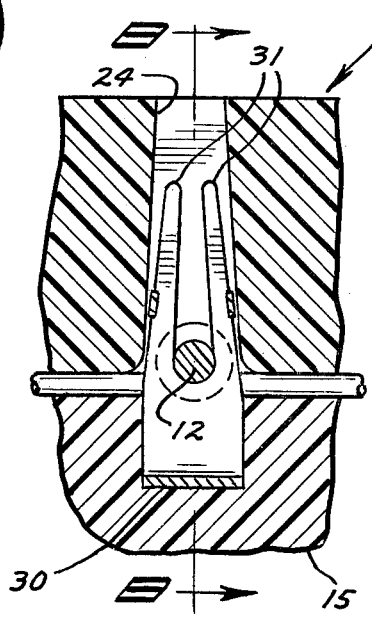
Figure 8:
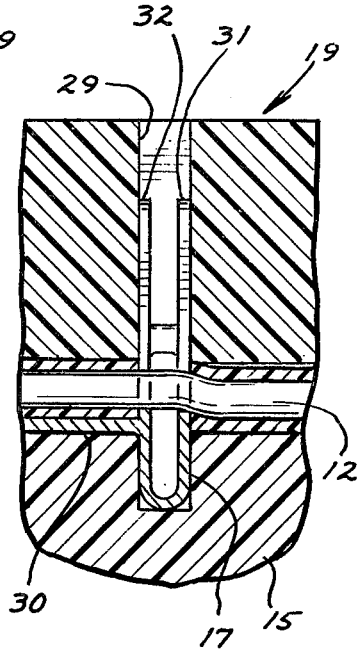

Connector assembly 10 also includes a cover member 19 which includes horizontal wire receptacles 20 and 22 and vertical wire receptacles 21 and 23, respectively. Cover member 19 further includes a plurality of tapered apertures 24 which are disposed to lie in registration with the plurality of recesses 17 and like plurality of portions 31 and 32 on connectors 28. The taper is shown more generally on FIG. 6 of the drawings and further illustrates, in FIG. 7, the relationship of bifurcated ends 31 and 32 after insertion into tapered apertures 24 to effect a reliable conductive connection with conductor 12. Cover member 19 further includes a center plug portion 25 which is adapted to coact with and extend into a corresponding recess in base member 15 along the center portion thereof so as to engage with and coact with a flat ribbon cable 11 that may extend thereinto to provide a strain relief therefor to prevent interruption or interference with the connection effected between bifurcated ends 31 and 32 on connectors 28 when cables 11 are disposed in a generally horizontal plane with respect to the assembly as disclosed in FIG. 4.

Figure 4:
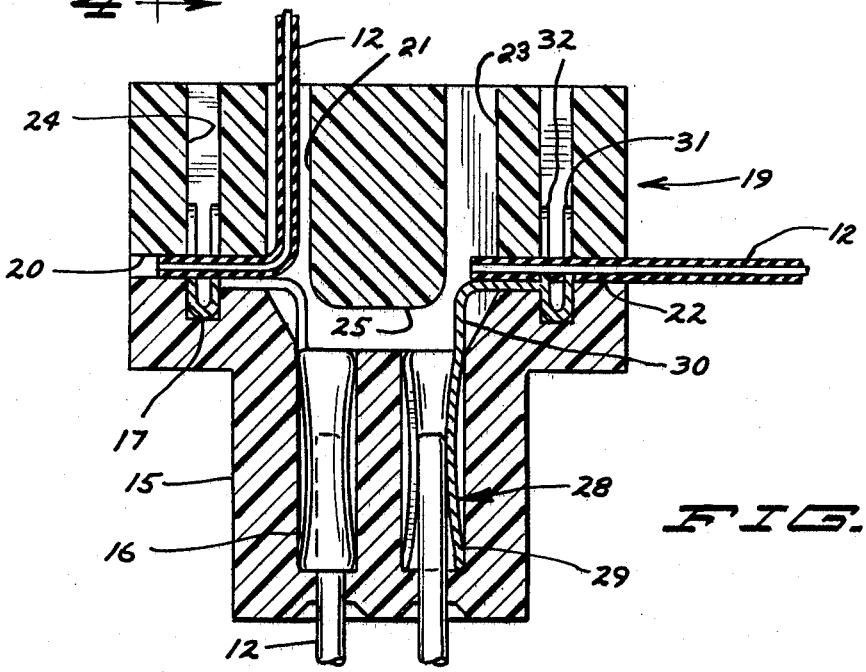
FIG. 4 is an enlarged sectional view taken along section lines 4—4 in FIG. 2 of the drawing.

End cables 11 may also be disposed in a generally vertical position as illustrated on the lefthand end of FIG. 4. The right angle turn through aperture 21 serves as a strain relief to prevent interference with the connection between bifurcated ends 31 and 32 of connector 28.

Figure 2:
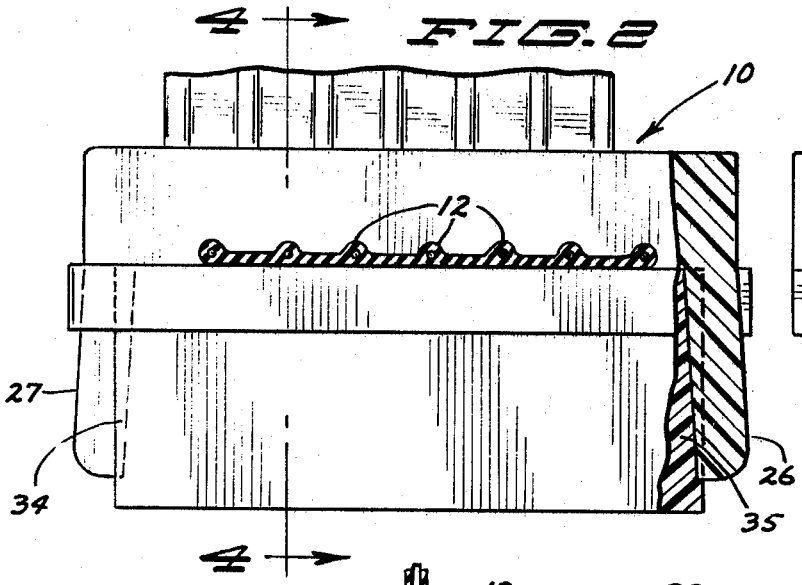
FIG. 2 is a side elevational view of the embodiment illustrated in FIG. 1 with a portion thereof broken away to further illustrate a sectional coaction of the elements thereof.
Figure 3:
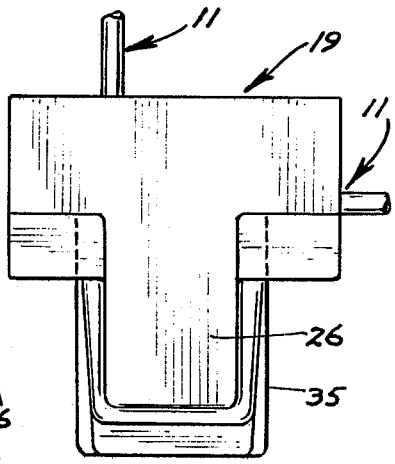
FIG. 3 is an enlarged end view of the device of FIGS. 1 and 2.
Figure 5:
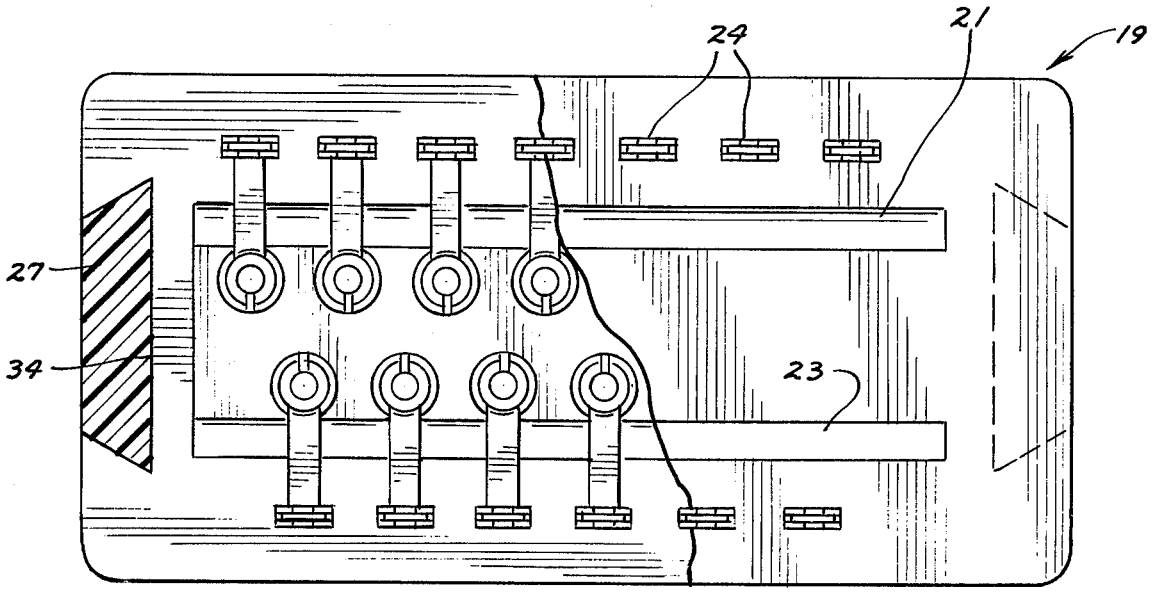
FIG. 5 is an enlarged plan view with a portion thereof broken away to illustrate the relationship of the elements of my invention.

Cover 19 is further provided with a pair of end portions 26 and 27 which are generally parallel and of like constant longitudinal cross section in the generally dovetailed configuration illustrated in the drawings at FIGS. 1 and 5. These members are dimensioned to interact and cooperate with the generally dovetailed shaped apertures formed and disposed at either ends 24 and 25 of base members 15 to extend for a short distance downwardly from the top surface thereof to slidably receive downwardly extending ends 26 and 27 of cover 19. The end portions of the lower part of base member 15 are dimensioned to be slightly tapered outwardly so that as cover 19 is pressed downwardly on top of base 15, its outer portions 26 and 27 are laterally outwardly displaced to tend to serve as a locking slidable connection between cover member 19 and base member 15 and to receive and retain the elements in relationship of FIGS. 2, 4 and 7, so as to complete and maintain the conductive, strain relieving connection of cable 11 and its component conductors 12, with connector assembly 12.

It may be appreciated by those skilled in the art that other forms and configurations of the several elements of my invention, including the relationship between the bifurcated ends and pin receiving ends of connectors 28 and their attendant respective positions in base or cover portions 15 or 19 of connector assembly 10 may be modified to suit other applications of my invention.

Having now therefore fully illustrated and described my invention, what I claim to be new and desire to protect by Letters Patent is:

1. A solderless connector comprising in combination;

a base member having a top surface and including a plurality of contact receiving apertures disposed normal to said top surface;

contact means disposed in at least one of said apertures in said base, said contact means including a pair of upwardly extending legs adapted to conductively engage an electrical conductor, the legs on said contact means having inner opposed portions in parallelism prior to engagement with a conductor;

a cover member having a bottom surface and a like plurality of apertures and adapted to be removably disposed on said base with respective apertures in registration, the apertures in said cover being tapered so that the ends adjacent the bottom surface are larger than the ends remote from said bottom surface whereby assembly of said cover on said base causes the inner portions of the contact means to assume and retain a non-parallel disposition so that a conductor held therebetween is subjected to an increasing contact pressure as said cover is disposed on said base, and the cover member includes channel portions extending from the outer surfaces thereof to said apertures in which the channels extend between two non-parallel outer faces of the cover member.

2. A solderless connector comprising in combination;

a base member having a top surface and including a plurality of contact receiving apertures disposed normal to said top surface;

contact means disposed in at least one of said apertures in said base, said contact means including a pair of upwardly extending legs adapted to conductively engage an electrical conductor, the legs on said contact means having inner opposed portions in parallelism prior to engagement with a conductor;

a cover member having a bottom surface and a like plurality of apertures and adapted to be removably disposed on said base with respective apertures in registration, the apertures in said cover being tapered so that the ends adjacent the bottom surface are larger than the ends remote from said bottom surface whereby assembly of said cover on said base causes the inner portions of the contact means to assume and retain a non-parallel disposition so that a conductor held therebetween is subjected to an increasing contact pressure as said cover is disposed on said base, the cover member includes channel portions extending from the outer surfaces thereof to said apertures and between two non-parallel outer faces of the cover member, the cover member includes a centrally disposed portion extending downwardly from its lower surface and the top surface of the base has a recess in registration therewith.

* * * * *